US005275344A

United States Patent [19]

Ray

[11] Patent Number: 5,275,344

[45] Date of Patent: Jan. 4, 1994

[54] PASTER TAB

[76] Inventor: Dennis Ray, 2488 Highway 62 East, Boonville, Ind. 47601

[21] Appl. No.: 952,048

[22] Filed: Sep. 28, 1992

[51] Int. Cl.[5] ..... B65H 19/18

[52] U.S. Cl. ..... 242/58.5

[58] Field of Search ..... 242/58.5, 58.3, 58.4, 242/58.1; 24/67 AR; 156/502, 504, 157, 159; 428/40, 41, 57, 194

[56] References Cited

U.S. PATENT DOCUMENTS

| | | | |
|---|---|---|---|
| 1,996,497 | 4/1935 | Wood | 242/58.5 |
| 2,149,832 | 3/1939 | Bernard | 242/58.5 |
| 2,149,833 | 3/1939 | Bernard | 242/58.5 |
| 2,377,971 | 6/1945 | Roesen | 242/58.5 |
| 2,812,145 | 11/1957 | Meloche | 242/58.5 |
| 3,001,735 | 9/1961 | Francik | 242/58.5 |
| 3,006,568 | 10/1961 | Willis | 242/58.5 |
| 3,231,949 | 2/1966 | Phipps | 24/67 AR |
| 3,547,739 | 12/1970 | Beute | 156/504 |
| 3,724,003 | 4/1973 | Baker | 242/58.5 |
| 4,575,017 | 3/1986 | Pali | 242/58.3 |
| 4,905,924 | 3/1990 | Moore | 242/58.5 |
| 5,212,002 | 5/1993 | Madrzak et al. | 242/58.5 X |

FOREIGN PATENT DOCUMENTS

| | | | |
|---|---|---|---|
| 591964 | 9/1947 | United Kingdom | 242/58.5 |

*Primary Examiner*—John M. Jillions

*Attorney, Agent, or Firm*—Flynn, Thiel, Boutell & Tanis

[57] ABSTRACT

A paster tab for use in splicing a leading end of a web on a rotary new roll to a running web on an expiring roll includes an elongated, uniformly thin, base layer having opposite facing sides with adhesive applied at various locations on the oppositely facing sides thereof. At least a pair of elongated die-cut slots extend transversely across a majority of the width of the base layer and through the thickness thereof. Mutually adjacent ends of the die-cut slots are separated from one another by a tearable narrow uncut part of the base layer. The narrow uncut part defines a vertex of an angle defined by the die-cut slots, which die-cut slots are straight and diverge from the narrow uncut part toward one of the ends of the base layer. An adhesive is applied to a surface of the base layer opposite the surface adapted to be bonded to the outer surface of the leading end as well as the outer surface of the rotary new roll. This adhesive extends up to an edge of the narrow uncut part and an edge of each of the die-cut slots. A surface area on the opposite side of the base layer from the adhesive which is adapted to become bonded to an expiring web is entirely free of adhesive.

12 Claims, 2 Drawing Sheets

PASTER TAB

FIELD OF THE INVENTION

This invention relates to a paster tab for use in splicing a leading end of a web on a rotary new roll to a running web on an expiring roll.

BACKGROUND OF THE INVENTION

Paster tabs, or splicing webs as they are also called, are known in the art and U.S. Pat. Nos. 2,149,832, 2,149,833, 2,377,971, 2,812,145, 3,001,735, 3,006,568, 3,231,949, 4,575,017 and 4 905 924 are representative examples thereof. One of the problems confronting a user of such paster tabs is that a rotary new web must be quickly and securely fastened to a running web without failure so that the leading end of the rotary new web will travel with the running web and effect an unwinding of the new web from the roll on which it is supported. If the attempt to secure the leading end of a web on a rotary new roll fails and the running web on the expiring roll comes to an end, considerable down time in a system utilizing roll stock will be experienced as the web of the rotary new roll is threaded through the system so that the system can be restarted. One such system is a newspaper printing system wherein a continuous feed of roll paper stock is required in order to print newspapers.

The paster tabs known heretofore have not been entirely satisfactory due to the fact that the occurrence of "missed" securements of the leading end of a web on a rotary new roll to a running web on an expiring roll is much too frequent. Accordingly, it is desirable to effect a development of a new paster tab which will overcome the problems and disadvantages of the known paster tabs.

Accordingly, it is an object of this invention to provide a paster tab which will effect a splicing of a leading end of a web on a rotary new roll to a running web on an expiring roll without failure.

It is a further object of this invention to provide a paster tab, as aforesaid, wherein at least a pair of elongated die-cut slots extend transversely across a majority of a width of a base layer of the paster tab and through a thickness thereof, mutually adjacent ends of the aforesaid at least pair of elongated die-cut slots being separated from one another by a tearable narrow uncut part of the base layer, the narrow uncut part defining a vertex of an angle defined by the diecut slots which extend in a diverging manner from the narrow uncut part toward one of the ends of the paster tab.

It is a further object of this invention to provide a paster tab, as aforesaid, wherein an adhesive is applied to a surface area of the base layer which is on a side of the base layer facing away from the rotary new roll and is adjacent an edge of the narrow uncut part and an edge of the die-cut slots, there being no adhesive on a side directly opposite thereto, so that when the adhesive contacts the running web, the adhesive will effect an adhering of the base layer to the running web and the tearable narrow uncut part will tear and, due to the absence of adhesive on the side directly opposite thereto, allow a part of the base layer having the aforesaid adhesive thereon to peel away from the outer facing surface of the rotary new roll to cause the leading end of the rotary new roll to travel with the running web adhesively secured thereto by the aforesaid adhesive.

It is a further object of this invention to provide a paster tab, as aforesaid, wherein a base layer between the narrow uncut part and an end thereof is of sufficient width to resist tearing the moment the aforesaid adhesive contacts the running web to cause the leading end of the rotary new roll to become connected to the running web through the aforesaid base layer.

It is a further object of this invention to provide a paster tab, as aforesaid, wherein the adhesive for effecting a securement of the leading end of the rotary new roll to a running web has a tackiness which is greater than the tackiness of a further adhesive for effecting a securement of the paster tab to an outer facing surface of the rotary new roll with the base layer thereof bridging a gap between the leading end and the outer facing surface.

SUMMARY OF THE INVENTION

The objects and purposes of this invention have been met by providing a paster tab which is capable of splicing a leading end of a web on a rotary new roll to a running web on an expiring roll, which paster tab includes an elongated, uniformly thin, base layer having opposite first and second ends and oppositely facing first and second surfaces, the base layer having at least a pair of elongated die-cut slots extending transversely across a majority of a first-width dimension of the base layer and through a thickness thereof. Mutually adjacent ends of the pair of elongated die-cut slots are separate from one another by a tearable narrow uncut part of the base layer. The narrow uncut part defines a vertex of an angle defined by the die-cut slots, which angle extends in a diverging manner from the narrow uncut part toward the second end. A first adhesive layer is provided on at least a pair of separate lengthwise-spaced areas on the first surface. A first of the separate surface areas adjacent the first end is covered by the first adhesive up to a transversely extending first limit. A second of the separate surface areas adjacent the second end is also covered by the first adhesive layer up to a transversely extending second limit spaced lengthwise toward the second end from the narrow uncut part. A second adhesive layer is provided on a majority of a third surface area of the second surface from the aforesaid second end to an edge of the narrow uncut part and an edge of the die-cut slots. A third surface area on the first surface between the second limit and at least a line defined by the narrow uncut part and the pair of elongated die-cut slots is free of adhesive.

BRIEF DESCRIPTION OF THE DRAWINGS

Other objects and purposes of this invention will become apparent to persons acquainted with this particular art and upon reading the following specification, reference being made to the drawings, in which.

DETAILED DESCRIPTION

Figure 1:
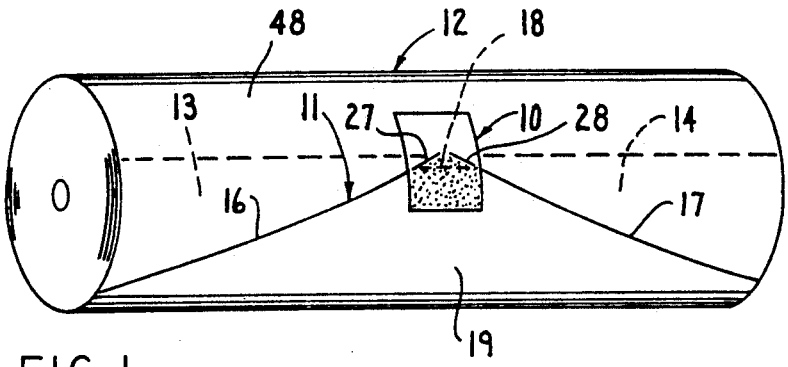
FIG. 1 is an isometric view of a rotary new roll having a paster tab embodying my new invention adhesively attached thereto.

A paster tab 10 embodying my new invention is shown in FIG. 1 applied to the leading end 11 of a rotary new roll 12. The leading end 11 on the roll 12 has been appropriately prepared by removing triangular-shaped sections 13 and 14 so that mutually adjacent ends of the leading edges 16 and 17 of the leading end 11 will form a straight end segment as at 18.

Figure 2:
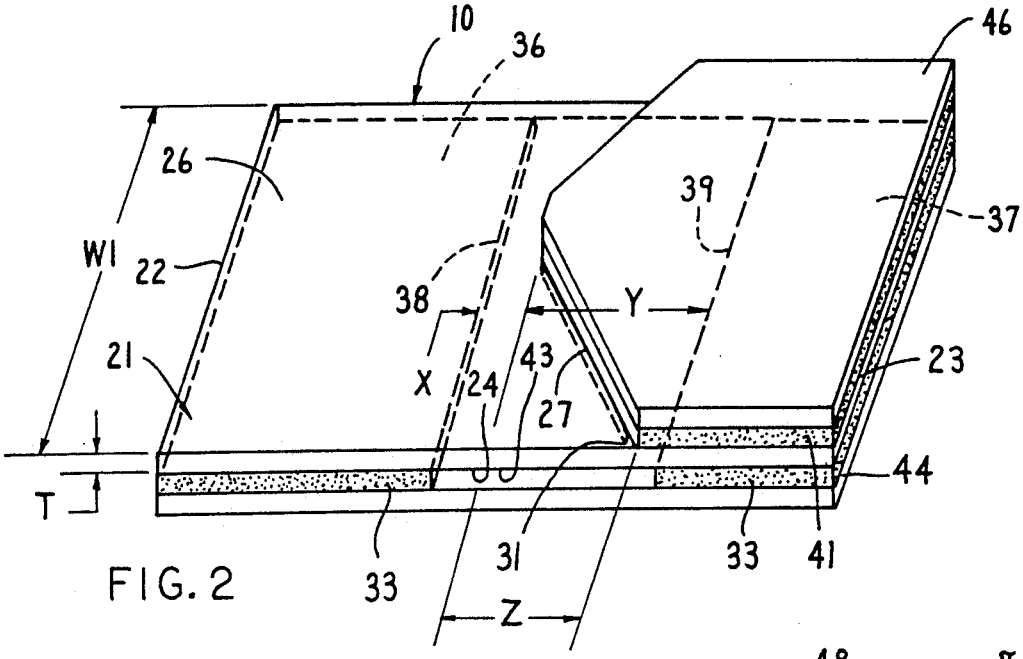
FIG. 2 is an enlarged isometric view of a paster tab embodying my new invention.

FIG. 2 illustrates an enlarged isometric view of the paster tab 10 illustrated in FIG. 1. The paster tab includes a base layer 21 having opposite first and second ends 22 and 23 and oppositely facing first and second surfaces. The base layer 21 has at least a pair of elongated die-cut slots 27 and 28 extending transversely across a majority of a width dimension W1 of the base layer 21 and through the thickness T thereof. Mutually adjacent ends of the die-cut slots 27 and 28 are separated from one another as at 29 by a tearable narrow uncut part of the base layer 21. The narrow uncut part 29 defines a vertex of an angle defined by the die-cut slots 27 and 28 which are, in this embodiment, straight-line slots, diverging from the narrow uncut part 29 toward the second end 23. The laterally outboard end of each of the slots 27 and 28 terminates in a further tearable and narrow uncut part 31 and 32, respectively. The straight end segment 18 of the new roll 12 preferably is aligned with the outboard edges of the uncut parts 31 and 32 as shown in FIG. 5.

A first adhesive layer 33 is applied to a pair of separate lengthwise-spaced areas 36 and 37 on the first surface 24. A first of the separate areas 36 adjacent to the first end 22 is covered by the aforesaid first adhesive 33 up to a transversely extending first limit 38. In this particular embodiment, the limit 38 is a straight line extending across the entire lateral width W1 of the first surface 24 and is spaced lengthwise from the narrow uncut part by a dimension X. The entirety of the first area 36 is covered by the aforesaid adhesive 33. The second area 37 adjacent the second end 23 of the base layer 21 is covered by the first adhesive 33 up to a transversely extending second limit 39. In this particular embodiment, the second limit is parallel to the first limit 38. Further, the second limit is spaced a distance Y from the narrow uncut part 29. In this particular embodiment, the dimension Y is greater than a dimension Z between the uncut part 29 and the outboard lateral edge of the uncut parts 31 and 32.

Figure 5:
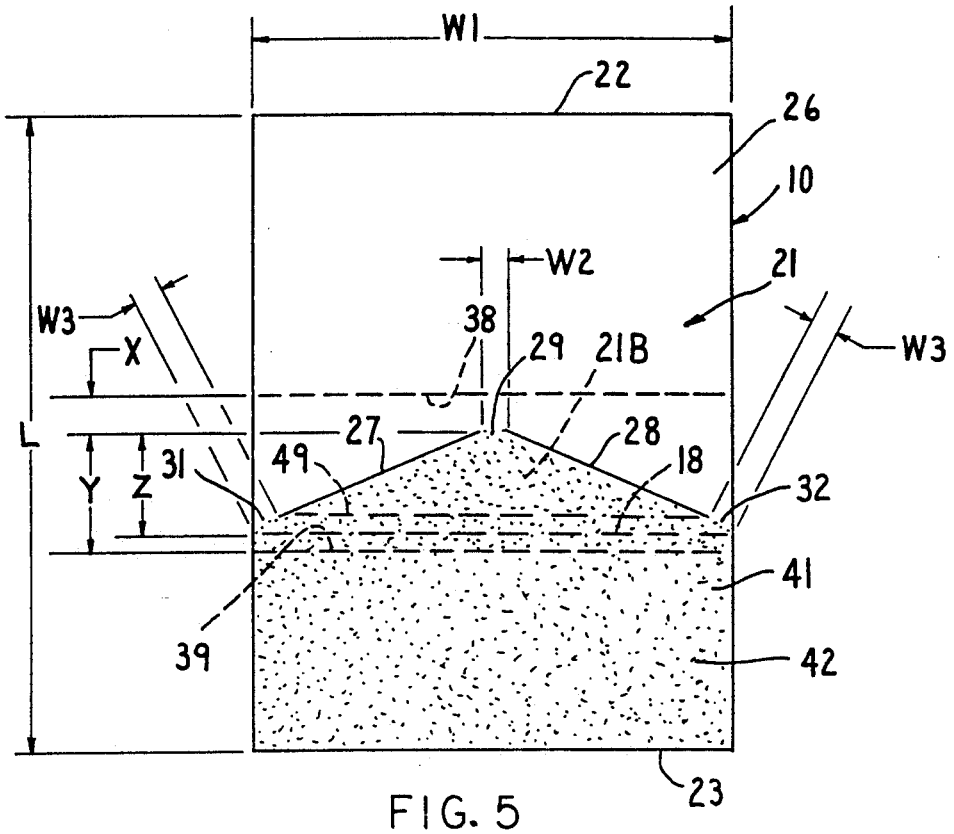
FIG. 5 is a view of one of the faces of my new paster tab.

A second adhesive 41 is provided on a surface area 42 that is shaded in FIG. 5. It will be noted that in this particular embodiment, the second adhesive layer 41 covers the entirety of the surface area 42 from the second end 23 to an edge of the uncut part 29 and an edge of the die-cut slots 27 and 28 and an edge of the uncut parts 31 and 32. Further, the second surface 26 between the uncut part 29, the die-cut slots 28 and 29 and the uncut parts 31 and 32 on the one hand, and the first end 22, on the other hand, is also free of adhesive. A surface area 43 on the first surface 24 bounded by the lateral edges of the base layer 21 and at least the pair of die-cut slots 27 and 28 is free of adhesive. In the preferred embodiment, the surface area 43 actually includes the area bounded by the lateral edges of the base layer 21 and the first and second limits 38 and 39.

A protective liner 44 is provided for covering the adhesives 33 applied to the first surface 24 of the base layer 21. Similarly, a liner 46 is provided for covering the second adhesive 41 applied to the second surface 26. Both liners 44 and 46 are provided for the purpose of protecting the first and second adhesives 33 and 41, prior to use, from premature contact. Further, the liners 44 and 46 are adapted to be peeled off from the respective adhesive to expose the adhesive for further use.

In this particular embodiment, a width W2 of the uncut part 29, as well as the widths W3 of the uncut parts 31 and 32, are in the range of 1/16" to ⅜" when the width dimension W1 is in the range of 2.0"–4.0". In the preferred embodiment, the widths W2 and W3 are ⅛" and the width W1 is 3.0". The length L is, in the preferred embodiment, 4.0" and the uncut part 29 is centrally located along the central longitudinal axis of the paster tab between the first and second ends 22 and 23, respectively. The dimension X is ¼" and the dimension Y is ⅜". The spacing between the first end 22 and the first limit 38 is 1⅜" whereas the spacing between the second end 23 and the second limit 39 is 1¼".

Figure 3:
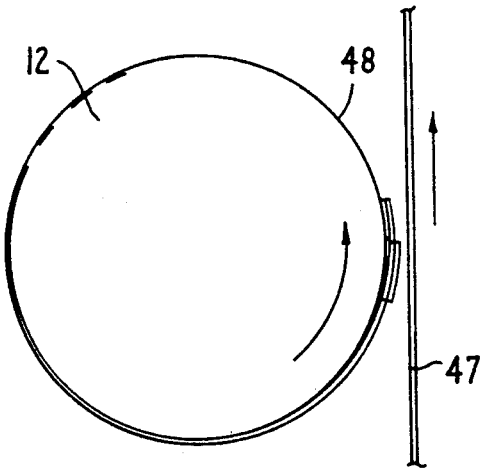
FIG. 3 is an end view of a rotary new roll about to be spliced to a running web of an expiring roll.
Figure 4:
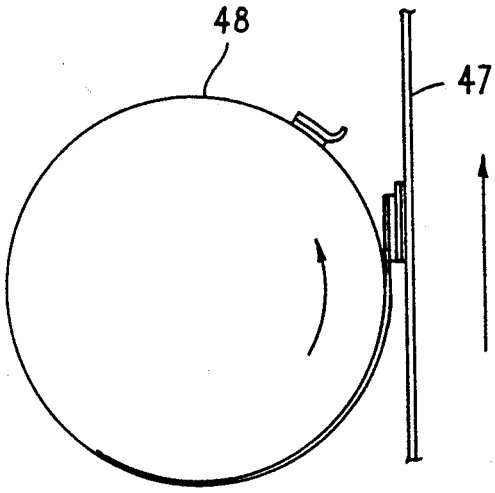
FIG. 4 is an end view similar to FIG. 3, but wherein the leading end of a web on the rotary new roll has been spliced to the running web on the expiring roll.
Figure 7:
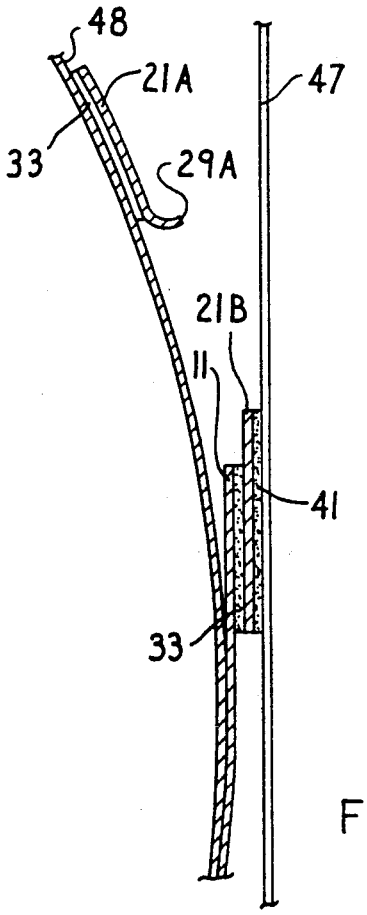
FIG. 7 is an enlarged fragment of the paster tab immediately after a successful splicing of the leading end of the web on the rotary new roll to the running web on an expiring roll has been effected.
Figure 6:
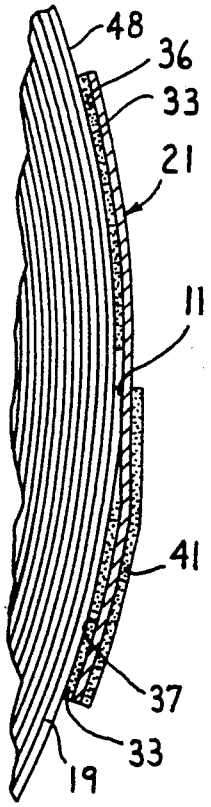
FIG. 6 is an enlarged sectional view through the paster tab embodying my new invention and a fragment of the rotary new roll.

When it is desired to splice the leading end 11 of a web 19 on the rotary new roll 12 to a running web 47 on a not-illustrated expiring roll, the liner 44 is first removed from its protective relation with the adhesives 33 so that the adhesive 33 on the surface area 37 can be applied to the outer surface of the leading end 11 of the web 19 with the leading edges 16 and 17 being respectively generally aligned with the die-cut slots 27 and 28. The adhesive 33 on the surface area 36 is bonded to the outer surface 48 of the roll 12. Next, the liner 46 is removed to expose the second adhesive 41 as illustrated in FIG. 6. As is depicted by comparing FIGS. 3 and 4, the rotary new roll 12 is brought into closer relation to the running web 47 so that on the first pass of the second adhesive 41 past the running web 47, the second adhesive 41 will, due to its sufficient tackiness, adhere to the running web with sufficient tenacity as to cause the narrow uncut part 29 to tear as at 29A (FIG. 7) separating the base layer 21 into two components 21A and 21B. The base layer component 21B is now adhesively secured via the adhesive 41 to the running web 47. Since no adhesive is applied to the surface area 43 between the first and second limits 38 and 39, and following a tearing of the uncut part 29, the portion 21B of the now-severed base layer 21, which portion 21B is defined by a line 49 (FIG. 5) extending between the laterally outboard ends of the die-cut slots 27 and 28, as well as by the die-cut slots 27 and 28 and the uncut part 29, is free to move with the running web 47 due to the fact that there is no adhesive on the opposite side of the portion 21B of the base layer 21 from the second adhesive 41. Since the die-cut slots 27 and 28 are angularly related to one another by an obtuse angle as shown in FIG. 5, when the portion 21B of the base layer 21 has been removed a sufficient distance from the outer surface 48 of the roll 12, the uncut parts 31 and 32 Will be torn to complete the splice and cause the entirety of the leading end 11 of the new roll 12 to move with the running web 47.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A paster tab for use in splicing a leading end of a web on a rotary new roll to a running web of an expiring roll, comprising:

an elongated, uniformly thin, base layer having opposite first and second ends and oppositely facing first and second surfaces, said base layer having means defining at least a pair of elongated die-cut slots extending transversely across a majority of a first width dimension of said base layer and through a thickness thereof, mutually adjacent ends of said at least pair of elongated die-cut slots being separated from one another by a tearable narrow uncut part of said base layer, said narrow uncut part defining a vertex of an angle defined by said die-cut slots, which extend in a diverging manner from said narrow uncut part toward said second end;

a first adhesive layer on at least a pair of separate lengthwise spaced areas on said first surface, a first of said separate surface areas adjacent said first end being covered by said first adhesive up to a transversely extending first limit, a second of said separate surface areas adjacent said second end being also covered by said first adhesive layer up to a transversely extending second limit spaced lengthwise toward said second end from said narrow uncut part;

a second adhesive layer covering a majority of a third surface area of said second surface from said second end to an edge of said narrow uncut part and an edge of said die-cut slots; and a third surface area on said first surface between said second limit and at least a line defined by said narrow uncut part and said at least a pair of elongated die-cut slots being free of adhesive.

2. The paster tab according to claim 1, wherein said at least a pair of elongated die-cut slots are straight.

3. The paster tab according to claim 2, wherein an end of said die-cut slots adjacent lateral edges of said base layer are separated laterally inwardly from said lateral edges by a further tearable uncut part.

4. The paster tab according to claim 3, wherein said uncut part has a second width dimension which is in the range of 1/16" to ⅜" when said first width dimension is in the range of 2.0"–4.0".

5. The paster tab according to claim 4, wherein said further uncut part has a third width equal to said second width.

6. The paster tab according to claim 5; wherein said first width dimension is 3.0" and said first and second adhesives cover their respective surfaces across the entirety of said first width dimension.

7. The paster tab according to claim 1, wherein said first and second adhesives are covered by a peel-off liner in order to protect said first and second adhesives, prior to use, from premature contact.

8. The paster tab according to claim 1, wherein said first and second adhesives are both pressure-sensitive adhesives, said first adhesive on said second surface area having sufficient tackiness to adhere to the leading end of the web on the rotary new roll, said first adhesive on said first surface area having a sufficient tackiness to adhere to an outer facing surface on the rotary new roll immediately adjacent the leading end, said third surface area opposing a gap between the leading end and the outer facing surface; and whereby when said second adhesive on a side of said base layer opposite said third surface area contacts the running web, said second adhesive will effect an adhering of said base layer to said running web and said tearable narrow uncut part will tear and, due to an absence of adhesive on said third surface area and said elongated die-cut slots, allow a part of said base layer having said third surface area thereon to peel away from said outer facing surface of the rotary new roll to cause the leading end of the rotary new roll to travel with the running web adhesively secured thereto by said second adhesive.

9. The paster tab according to claim 1, wherein said first limit is a straight line oriented perpendicular to a longitudinally extending central axis of said base layer, said first limit being spaced lengthwise from said narrow uncut part.

10. The paster tab according to claim 9, wherein said second limit is parallel to said first limit and is spaced lengthwise toward said second end from said narrow uncut part and each of said at least a pair of elongated die-cut slots.

11. The paster tab according to claim 10, wherein said third surface area is bounded by the lateral edges of said base layer and said first and second limits.

12. The paster tab according to claim 1, wherein said base layer is in the range of 2.0 to 3.0 mils thick.

* * * * *